United States Patent [19]

Przybylek

[11] 3,947,713

[45] Mar. 30, 1976

[54] MERCURY CAPSULE ASSEMBLY FOR DISPLAY PANEL

[75] Inventor: George J. Przybylek, Martinsville, N.J.

[73] Assignee: Burroughs Corporation, Detroit, Mich.

[22] Filed: Apr. 18, 1975

[21] Appl. No.: 569,223

[52] U.S. Cl. ..... 313/174; 222/3

[51] Int. Cl.[2] ..... H01J 61/24

[58] Field of Search ..... 313/174, 176, 177, 220; 417/48, 49; 222/3, 5; 141/66, 8

[56] References Cited

UNITED STATES PATENTS 3,872,339 3/1975 Maloney ..... 313/177 X

*Primary Examiner*—Robert J. Corcoran
*Assistant Examiner*—Darwin R. Hostetter
*Attorney, Agent, or Firm*—Kevin R. Peterson; Robert A. Green; William B. Penn

[57] ABSTRACT

The apparatus of the invention comprises a cup-shaped metal ring carrying a mercury amalgam from which mercury can be released, the ring being held within a supporting mass of fibrous insulating material and the entire assembly loosely mounted in the tubulation secured to the base plate of a display panel.

7 Claims, 3 Drawing Figures

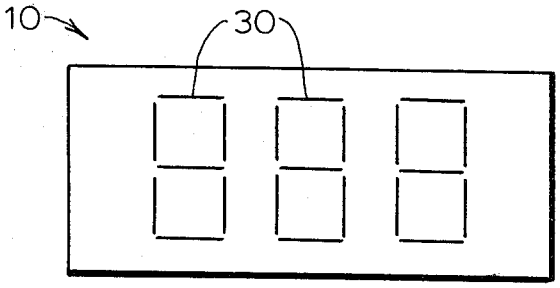
Fig. 1
Fig. 2
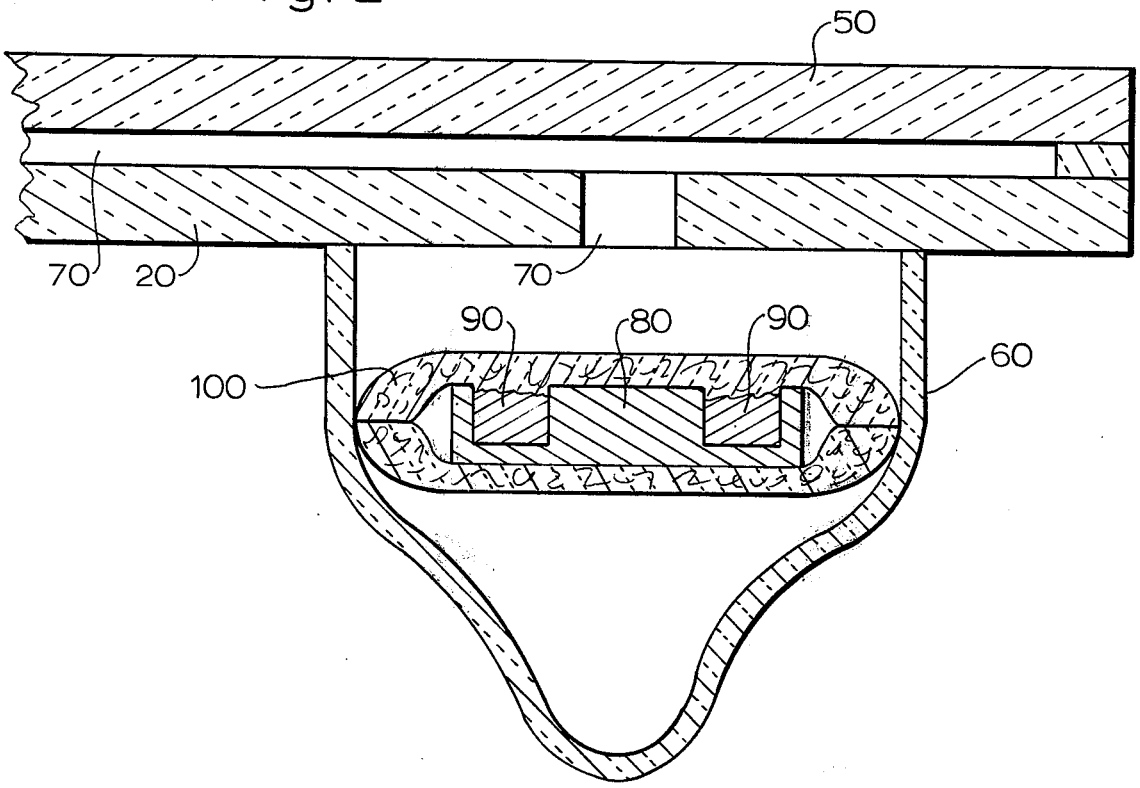
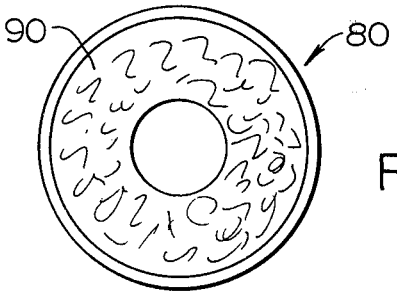
Fig. 3

MERCURY CAPSULE ASSEMBLY FOR DISPLAY PANEL

BACKGROUND OF THE INVENTION

At the present time, mercury vapor is provided in the gas atmosphere of all gas discharge display devices to minimize cathode sputtering. The mercury is introduced into such devices from a glass capsule held within the glass tubulation secured to the envelope. At a selected time in the manufacture of the panel, the glass capsule is shattered and mercury vapor enters the envelope through a hole therein. When such a mercury capsule is used with a flat display panel, the tubulation has to be specially shaped with a constricting portion to hold the mercury capsule in place. Such a tubulation is expensive.

In addition, in manufacture of the panel, first, the tubulation is sealed off below the mercury capsule, and then, after the mercury has been released therefrom, that portion of the tubulation is removed. This is an undesirable extra step in the manufacturing process.

In addition, with a glass capsule of this type, globules of mercury usually remain in the tubulation after the capsule has been opened, and some of this mercury can enter the panel through the hole in the envelope when the panel is handled, and such mercury can cause shorts inside the envelope.

A mercury capsule is known which comprises a metallic ring having a U-shaped cross-section and which carries a quantity of a mercury amalgam from which the mercury can be released by the application of heat. Such a mercury capsule is considerably cheaper than the glass capsule, and, as a result, it would be desirable to be able to use such a device; however, the carrier is too large for convenient use in tubulations. In addition, when such a carrier or capsule is mounted in a tubulation, it is in contact with the glass wall of the tubulation, and, when it is heated by RF energy, its heat subjects the tubulation to thermal shock, and the tubulation will generally crack.

Summary of the Invention

Briefly, the invention comprises a cup-like annular metal mercury capsule in a mass of fibrous insulating material which is mounted in the glass tubulation of a device which is to receive mercury vapor, the insulating material preventing the carrier from touching the glass wall of the tubulation, whereby any heat generated in the carrier is not transmitted suddenly to the glass wall.

DESCRIPTION OF THE DRAWINGS

FIG. 1 is a schematic plan view of a display panel embodying the invention;

FIG. 2 is a sectional view of a portion of the panel of FIG. 1 showing a mercury carrier embodying the invention; and FIG. 3 is a plan view of the carrier of FIG. 2.

DESCRIPTION OF THE PREFERRED EMBODIMENTS

Apparatus embodying the invention is useful with substantially any type of device which is to contain mercury vapor and into which the mercury is introduced from a carrier in a glass tubulation secured to the device. For purposes of illustrating the invention, a display panel of the type known as a PANAPLEX panel is shown schematically in the drawings and is described in relatively general terms. Devices which may use the invention are described in greater detail in U.S. Pat. No. 3,868,535.

Referring to the drawings and to FIGS. 1 and 2, a display panel 10 embodying the invention includes a base plate 20 of glass, ceramic, or the like, which carries a plurality of groups of cathode electrodes 30 in the form of segments, shown schematically, which are adapted to be energized in different combinations to display characters, as is well known in the art. The base plate also carries leads for the cathode electrodes and suitable insulating means as required; however, these are not shown, to simplify the drawings. The panel 10 also includes an anode electrode (not shown) for each group of cathode electrodes, and, in one arrangement, the anodes comprise thin films of tin oxide, formed on the lower surface of the face plate 50. The base plate and face plate are hermetically sealed together with a suitable gas-filled space between them to form the panel envelope. A glass tubulation 60, of well known shape, is secured to the base plate of the panel in alignment with a hole 70 in the base plate which communicates with the interior of the envelope.

According to the invention, mercury is introduced into the panel 10 from a mercury carrier or capsule 80 known as a giver-getter. This capsule, shown in FIGS. 2 and 3, comprises a generally cup-shaped ring which carries, in the cup portion, a mercury amalgam 90 from which mercury vapor can be released by the application of heat. The carrier 80, which is relatively thin and has a diameter somewhat smaller than the largest diameter of the tubulation, is embedded in a mass 100 of fibrous insulating material, such as Fiberfrax, and the assembly is loosely mounted within the tubulation. Of course, this is done before the tubulation is secured to the lower surface of the base plate. Thus constructed and positioned, the metal mercury carrier 80 itself does not touch the glass wall of the tubulation, but is insulated therefrom by the Fiberfrax material.

After the panel has been assembled with the tubulation and mercury carrier in place and it is processed as required, radio frequency energy is applied to the ring carrier 80 to heat it and to cause mercury vapor to escape therefrom and into the panel through the hole 70 in the base plate 20.

What is claimed is:

1. Apparatus for introducing a vapor into a chamber comprising an envelope having a chamber into which a vapor is to be introduced, a tubulation secured to said envelope in communication with said chamber, a carrier carrying a substance for providing said vapor, said carrier being dispsosed in said tubulation, and a mass of fibrous material enclosing said carrier and insulating said carrier from the wall of said tubulation.

2. Apparatus for introducing a vapor into a chamber comprising an envelope having a chamber into which a vapor is to be introduced, a tubulation secured to said envelope in communication with said chamber through a hole in said envelope, a carrier carrying a substance for providing said vapor, said carrier being disposed in said tubulation, and a mass of fibrous material enclosing said carrier and insulating said carrier from the wall of said tubulation.

3. Apparatus for introducing a vapor into a chamber comprising an envelope having a chamber into which a vapor is to be introduced, a tubulation secured to said envelope in communication with said chamber, an annular metal carrier carrying a substance for providing said vapor, said carrier being disposed in said tubulation, and a mass of fibrous material enclosing said carrier and insulating said carrier from the wall of said tubulation.

4. Apparatus for introducing a vapor into a chamber comprising an envelope made up of a base plate and a face plate sealed together and forming a chamber into which a vapor is to be introduced, a tubulation secured to said base plate of said envelope in communication with said chamber through a hole in said base plate, a carrier carrying a substance for providing said vapor, said carrier being disposed in said tubulation, and a mass of fibrous material enclosing said carrier and insulating said carrier from the wall of said tubulation.

5. A display device comprising a gas-filled envelope made up of a base plate and a face plate secured together, a glass tubulation secured to said base plate and communicating with the interior of said envelope through a hole in said base plate, a metal carrier for a chemical to be released therefrom and introduced into said envelope, and a fibrous mass surrounding said carrier and insulating said carrier from the wall of said tubulation.

6. A display panel comprising a gas-filled envelope containing a plurality of groups of cathode electrodes for displaying characters and at least one anode electrode, said envelope comprising a face plate and a base plate hermetically sealed together, a tubulation secured to said base plate and communicating with the interior of said envelope through a hole in said base plate, a carrier for a chemical to be released therefrom and introduced into said envelope, said carrier being mounted in said tubulation, and a fibrous mass surrounding said carrier and insulating said carrier from the wall of said tubulation.

7. The panel defined in claim 6 wherein said tubulation is of glass and said carrier is of metal.

* * * * *